US005433406A

United States Patent [19]

Chavez

[11] Patent Number: 5,433,406

[45] Date of Patent: Jul. 18, 1995

[54] TRASH BAG SUPPORT APPARATUS

[76] Inventor: Rodolfo P. Chavez, 9181 Browning Dr., Huntington Beach, Calif. 92646

[21] Appl. No.: 130,684

[22] Filed: Oct. 4, 1993

[51] Int. Cl.[6] ..... B65B 67/04

[52] U.S. Cl. ..... 248/99; 248/149

[58] Field of Search ..... 81/3.43, 64, 65; 248/99, 101, 100, 149; 294/1.1

[56] References Cited

U.S. PATENT DOCUMENTS

| | | | |
|---|---|---|---|
| 406,177 | 7/1889 | Morehouse et al. | 81/64 |
| 2,009,765 | 7/1935 | Davis | 81/64 |
| 2,058,949 | 10/1936 | Borowski | 81/3.43 |
| 2,389,301 | 11/1945 | Escher | 81/3.43 |
| 4,312,489 | 1/1982 | Paetzold | 248/97 |
| 4,660,758 | 4/1987 | Tavel et al. | 232/43.2 |
| 4,940,201 | 7/1990 | Kurth | 248/101 |
| 4,979,706 | 12/1990 | Feldman et al. | 248/101 |
| 5,014,943 | 5/1991 | Nelson et al. | 248/99 |
| 5,139,219 | 8/1992 | Navarro | 248/97 |

FOREIGN PATENT DOCUMENTS

| | | | |
|---|---|---|---|
| 0162603 | 6/1989 | Japan | 248/99 |

*Primary Examiner*—Karen J. Chotkowski
*Assistant Examiner*—Catherine S. Collins

[57] ABSTRACT

A spring strap member is arranged for positioning within a flexible bag, the spring strap member includes a first end and a second end, the first end mounted to a strap handle housing and the second end arranged for sliding projection through the housing, wherein the strap includes a row of apertures directed therethrough, with a latch mechanism mounted within the strap handle housing for engagement with one of the apertures to accommodate trash bags of various sizes to maintain the trash bag in an opened orientation for receiving debris and the like.

2 Claims, 4 Drawing Sheets

TRASH BAG SUPPORT APPARATUS

BACKGROUND OF THE INVENTION

1. Field of the Invention

The field of invention relates to trash bag support structure, and more particularly pertains to a new and improved trash bag support apparatus wherein the same is arranged for maintaining a trash bag in an open orientation within a container.

2. Description of the Prior Art

Trash bag holders such as indicated in U.S. Pat. No. 5,139,219 are available in the prior art for the purpose of maintaining a trash bag in the supported orientation. The above holed patent provides for a plate member arranged for reception within a trash bag.

The instant invention is directed to overcome deficiencies of the prior art by providing for a strap member arranged for encircling construction for supporting a trash bag in an open orientation and in this respect, the present invention substantially fulfills this need.

Further examples of prior art trash bag holders are indicated in U.S. Pat. Nos. 5,014,943; 4,940,201; and 4,312,489.

SUMMARY OF THE INVENTION

In view of the foregoing disadvantages inherent in the known types of trash bag support structure now present in the prior art, the present invention provides a trash bag support apparatus wherein the same is arranged for expansion within a trash bag for maintaining such trash bag in an open orientation for reception of waste material and debris. As such, the general purpose of the present invention, which will be described subsequently in greater detail, is to provide a new and improved trash bag support apparatus which has all the advantages of the prior art trash bag support apparatus and none of the disadvantages.

To attain this, the present invention provides a spring strap member arranged for positioning within a flexible bag, the spring strap member includes a first end and a second end, the first end mounted to a strap handle housing and the second end arranged for sliding projection through the housing, wherein the strap includes a row of apertures directed therethrough, with a latch mechanism mounted within the strap handle housing for engagement with one of the apertures to accommodate trash bags of various sizes to maintain the trash bag in an opened orientation for receiving debris and the like.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved trash bag support apparatus which has all the advantages of the prior art trash bag support apparatus and none of the disadvantages.

It is another object of the present invention to provide a new and improved trash bag support apparatus which may be easily and efficiently manufactured and marketed.

It is a further object of the present invention to provide a new and improved trash bag support apparatus which is of a durable and reliable construction.

An even further object of the present invention is to provide a new and improved trash bag support apparatus which is susceptible of a low cost of manufacture with regard to both materials and labor, and which accordingly is then susceptible of low prices of sale to the consuming public, thereby making such trash bag support apparatus economically available to the buying public.

Still yet another object of the present invention is to provide a new and improved trash bag support apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
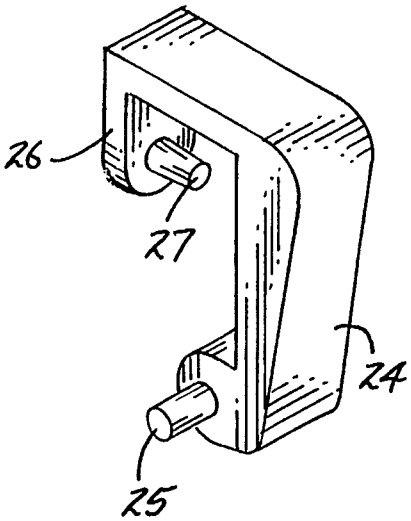
FIG. 2 is an isometric illustration of the actuator plate structure arranged for reception within the strap handle housing.
Figure 1:
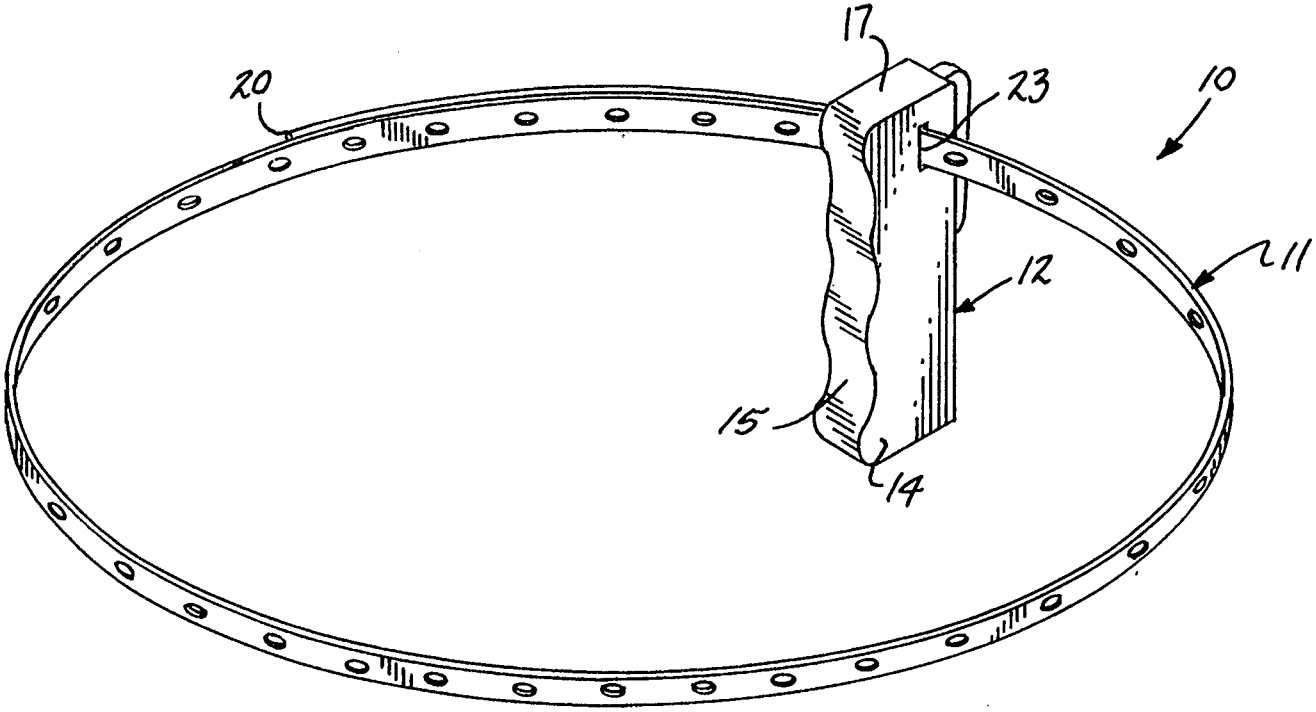
FIG. 1 is an isometric illustration of the invention.
Figure 4:
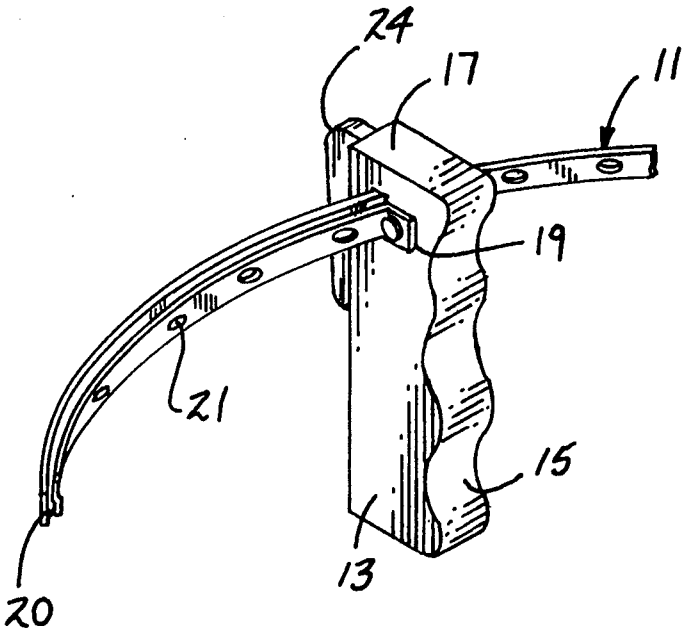
FIG. 4 is an isometric illustration of the strap handle housing mounted to a first end of the strap structure.

With reference now to the drawings, and in particular to FIGS. 1 to 7 thereof, a new and improved trash bag support apparatus embodying the principles and concepts of the present invention and generally designated by the reference numerals 10 and 10*a* will be described.

Figure 3:
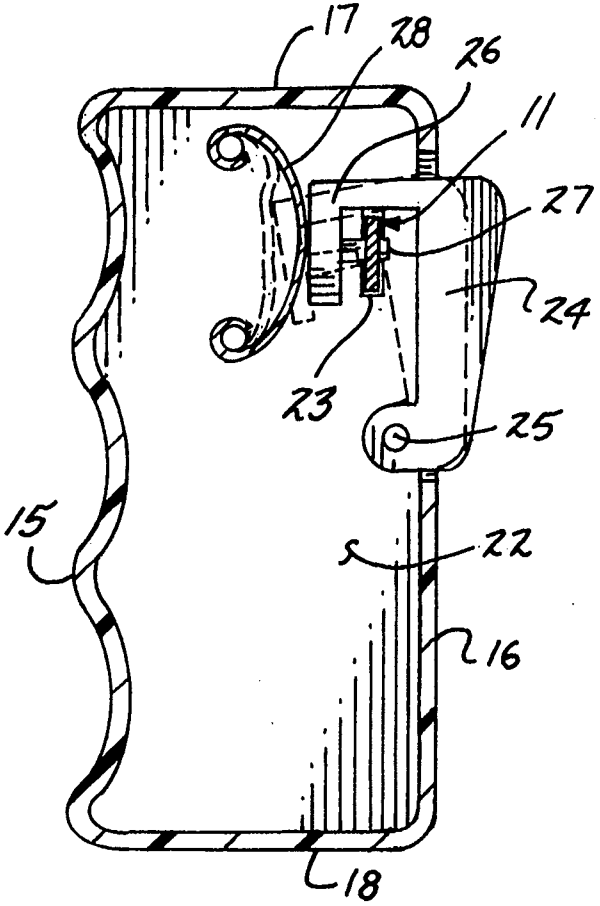
FIG. 3 is an orthographic cross-sectional illustration of the strap handle housing.

More specifically, the trash bag support apparatus 10 of the instant invention essentially comprises a spring strap 11 arranged in a generally hoop shaped configuration mounted to a strap housing 12. The strap housing 12 is formed with a first side wall 13 spaced from a second side wall 14, a front wall 15 having finger grooves directed therein arranged in a spaced relationship relative to a rear wall 16 and a top wall 17 spaced from a bottom wall 18. The strap 11 is formed with a strap first end 19 secured to the strap housing first side wall 13 (see FIG. 4) in adjacency to the top wall 17. The strap webbing is formed with a strap second end 20 and a row of strap apertures 21 directed through the strap 11 at spaced intervals. The strap 11 is accordingly received slidably through a housing slot 23 extending through the housing first and second side walls 3 and 14, as well as the housing cavity 22, as indicated in FIG. 3.

An L-shaped actuator plate 24 is arranged for sliding reception through the strap handle housing rear wall 16. The actuator plate 24 is formed with an extension leg 26 that is arranged in a facing relationship relative to the actuator plate 24, with a lock rod 27 fixedly mounted to the extension leg 26 projecting to the actuator plate 24. A pivot axle 25 at a first end of the actuator plate pivotally mounts the actuator plate relative to the strap handle housing 12, as indicated in FIG. 3, with the extension leg mounted to a second end of the actuator plate, as illustrated in FIG. 2. A spring member 28 positioned within the housing cavity 22 is arranged for abutment with the extension leg 26 to bias the extension leg and the lock rod 27 through one of the strap apertures 21, in a manner as indicated in FIG. 3. In this manner it may be understood that upon manual projection of the actuator plate 24 into the strap handle housing 12, the lock rod 27 is disengaged from one of the apertures 21 permitting sliding of the strap 11 through the housing slot 23 to expand or contract the strap for permitting mounting of the strap within a trash bag (not shown). Typically, the structure is positioned adjacent the mouth of the trash bag to maintain the mouth in an open orientation, of a type as desired in the prior art such as indicated in U.S. Pat. No. 5,139,219. The apparatus 10 and 10*a* may also be employed with a trash can (not shown) to capture the mouth of the trash bag between the strap 11 and the trash can structure.

Figure 5:
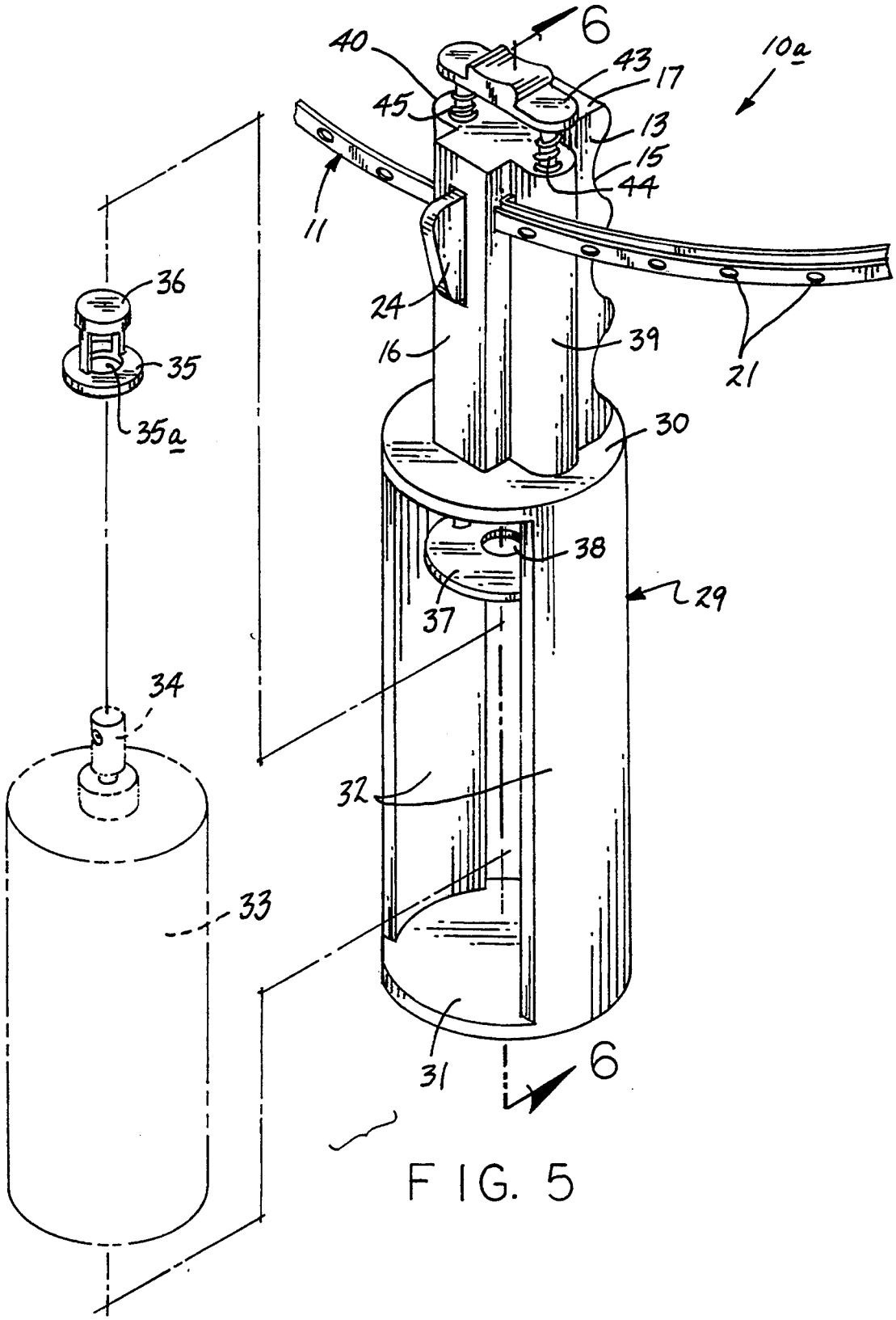
FIG. 5 is a partially exploded perspective view of a modified aspect of the invention.
Figure 6:
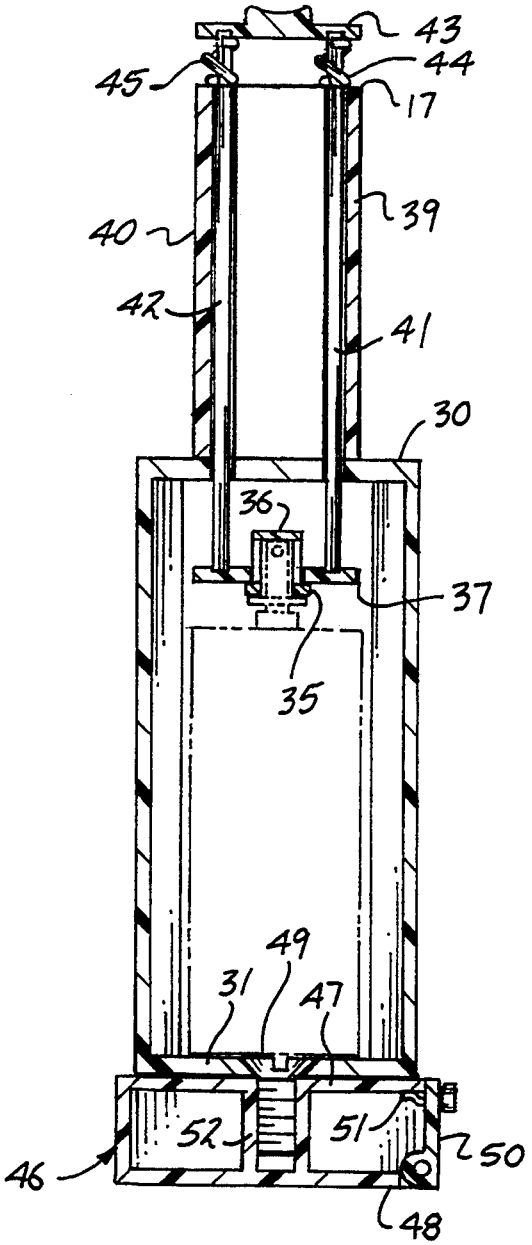
FIG. 6 is an orthographic view, taken along the lines 6—6 of FIG. 5 in the direction indicated by the arrows.

The apparatus 10*a*, such as indicated in FIG. 5, includes a support housing 29 having a support housing top wall 30 spaced from a support housing bottom wall 31. The support housing top wall 30 is fixedly secured to the strap handle housing bottom wall 18. A modified such strap handle housing is indicated in FIG. 5 to include first and second support bosses 39 and 40 parallel and coextensive relative to one another mounted to the respective strap handle housing's first and second side walls 13 and 14. The support housing 29 is further arranged to include spaced support housing side walls 32, such that an aerosol canister 33 having a nozzle 34 is received between the spaced support housing side walls 32 and the support housing's top and bottom walls 30 and 31 respectively. An abutment plate 35 is provided, having an abutment plate opening 35*a* to receive the aerosol nozzle 34 therethrough. A nozzle cap 36 secured to the abutment plate 35 is arranged for engaging a top surface the aerosol nozzle 34, in a manner as indicated in FIG. 6. An abutment disc 37 is positioned within the support housing 29, having an abutment disc opening 38 arranged to receive the nozzle cap 36 therethrough, but permitting the abutment disc 37 to contiguously engage the abutment plate 35, as illustrated in FIG. 6. First and second rods 41 and 42 in a parallel and coextensive relationship are slidably received through the first and second support bosses 39 and 40, with a rod plate 43 fixedly and orthogonally mounted to the first and second rods 41 and 42, with the rod plate 43 positioned in a spaced relationship relative to the strap handle housing top wall 17. In this manner, manual projection of the rod plate 43 towards the strap handle housing top wall projects the abutment disc 37 into the abutment plate 35 to effect compression and projection of the aerosol nozzle towards the aerosol container 33 to effect projection of an aerosol spray from the aerosol container. Such spray is typically of a deodorizing type commercially available and is arranged to provide selective odor control within a trash bag receiving the organization therewithin. The FIG. 6 illustrates respective first and second rod springs 44 and 45 receiving the respective first and second rods therethrough. The first and second rod springs are captured between the rod plate 43 and the top wall 17.

Figure 7:
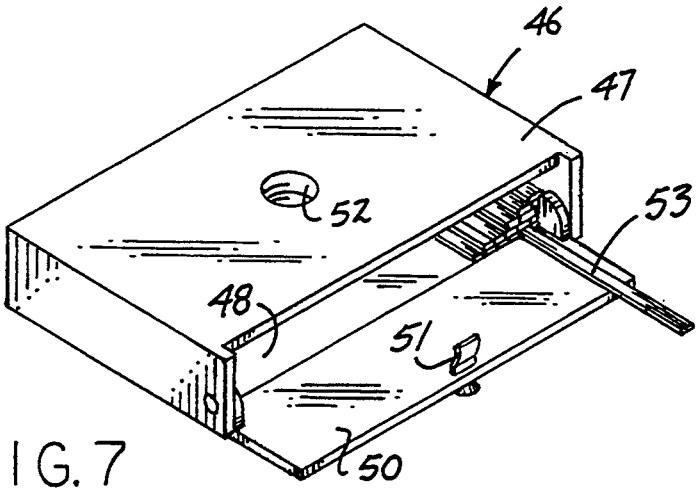
FIG. 7 is an isometric illustration of the container structure secured to the support housing bottom wall.

A container 46, as illustrated in FIGS. 6 and 7, fixedly mounted to the support housing bottom wall employs a fastener 49 directed through the support housing bottom wall and threadedly received within an internally threaded boss 52 and is fixedly mounted medially of and orthogonally to the container top wall and bottom walls 47 and 48. A door plate 50 is hingedly mounted to the container 46 at the container bottom wall 48, having a spring latch 51 to engage the container top wall 47 to provide for selective securement of the door in a closed orientation, as indicated in FIG. 6. The door plate 50 is opened, wherein typically, tie wraps 53 are stored within the container 46 for use in the tying of trash bags subsequent to their use by the invention permitting their tying at the mouth of such trash bags in a known manner for their disposal.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A trash bag support apparat, us, comprising, a spring strap arranged in a generally hoop shaped configuration, having a strap first end and a strap second end, and a strap handle housing, the strap handle housing including a first side wall spaced from a second side wall, a front wall spaced from a rear wall, and a top wall spaced from a bottom wall, and a cavity oriented within the strap handle housing and a slot directed through the first side wall and the second side wall extending through the cavity, with the spring strap received through the slot, and the strap first end mounted to the first side wall and the strap second end latch means mounted to the housing for securing the spring strap relative to the housing within the slot, and the spring strap includes a row of spaced apertures directed therethrough, and the latch means includes an actuator plate having a plate first end spaced from a plate second end, the plate first end having a pivot axle pivotally mounting the first end to the rear wall, and the actuator plate second end received within the cavity, and the actuator plate second end including an extension leg fixedly mounted to the actuator plate, with the extension leg in a facing relationship relative to the actuator plate, and the central leg including a lock rod fixedly mounted to the extension leg, with the lock rod received through one of the apertures, and a spring member mounted within the cavity in biased abutting relationship relative to the extension leg to bias the lock rod through one of said apertures, the bottom wall includes a support housing, the support housing having a support housing top wall fixedly mounted to the bottom wall, and a support housing bottom wall, and spaced support housing bottom wall, and spaced support housing side walls extending between the support housing top wall and the support housing bottom wall arranged to receive an aerosol canister within the support housing, with the aerosol canister including an aerosol nozzle, and an abutment plate having an abutment plate opening arranged to receive the aerosol nozzle therethrough, and a nozzle cap fixedly mounted to the abutment plate spaced from the abutment plate arranged to engage the aerosol nozzle, and an abutment disc having an abutment disc opening receiving the nozzle cap therethrough, with the abutment disc in contiguous abutting engagement to the abutment plate, and a first support boss mounted to the firsts side wall and a second support boss mounted to the second side wall, and a first rod slidably received through the first support boss, a second rod slidably received through the second support boss, the first rod and the second rod are arranged in contiguous abutting relationship relative to the abutment disc within the support housing, with the first rod and the second rod projecting above the top wall of the strap handle housing, with a rod plate fixedly mounted to the first rod and the second rod above the top wall of the strap handle housing, with a first rod spring captured between the rod plate and the top wall, and a second rod spring captured between the rod plate and the top wall to bias the rod plate in a spaced orientation relative to the top wall.

2. An apparatus as set forth in claim 1 including a container fixedly mounted to the support housing bottom wall, with the container including a container top wall spaced from a container bottom wall, and an internally threaded boss fixedly mounted between the container top wall and the container bottom wall, and a fastener directed through the support housing bottom wall and threadedly received within the internally threaded boss, and a door plate hingedly mounted to the container bottom wall, with the container arranged to receive tie wraps therewithin.

* * * * *